US009981315B2

(12) United States Patent
Rieken et al.

(10) Patent No.: US 9,981,315 B2
(45) Date of Patent: May 29, 2018

(54) ATOMIZER FOR IMPROVED ULTRA-FINE POWDER PRODUCTION

(71) Applicant: Iowa State University Research Foundation, Inc., Ames, IA (US)

(72) Inventors: Joel R. Rieken, Nevada, IA (US); Andrew J. Heidloff, West Des Moines, IA (US); Iver E. Anderson, Ames, IA (US)

(73) Assignee: Iowa State University Research Foundation, Inc., Ames, IA (US)

( * ) Notice: Subject to any disclaimer, the term of this patent is extended or adjusted under 35 U.S.C. 154(b) by 375 days.

(21) Appl. No.: 14/121,613

(22) Filed: Sep. 24, 2014

(65) Prior Publication Data

US 2016/0023277 A1 Jan. 28, 2016

Related U.S. Application Data

(60) Provisional application No. 61/960,726, filed on Sep. 24, 2013.

(51) Int. Cl.

| | |
|---|---|
| ***B22F 9/06*** | (2006.01) |
| ***B22F 9/08*** | (2006.01) |
| ***C22C 38/22*** | (2006.01) |
| ***C22C 38/06*** | (2006.01) |
| ***C22C 38/00*** | (2006.01) |
| ***B22F 1/02*** | (2006.01) |
| ***C22C 32/00*** | (2006.01) |

(52) U.S. Cl.

CPC ..... *B22F 9/082* (2013.01); *B22F 1/02* (2013.01); *C22C 32/0026* (2013.01); *C22C 38/002* (2013.01); *C22C 38/005* (2013.01); *C22C 38/06* (2013.01); *C22C 38/22* (2013.01); *B22F 2009/0892* (2013.01)

(58) Field of Classification Search

None

See application file for complete search history.

(56) References Cited

U.S. PATENT DOCUMENTS

| | | | | |
|---|---|---|---|---|
| 3,663,206 | A * | 5/1972 | Lubanska | B22F 9/082 264/12 |
| 4,619,845 | A | 10/1986 | Ayers | 427/422 |
| 4,905,899 | A * | 3/1990 | Coombs | B05B 7/1606 164/46 |
| 5,125,574 | A | 6/1992 | Anderson | 239/8 |
| 5,228,620 | A | 7/1993 | Anderson | 239/8 |
| 5,368,657 | A | 11/1994 | Anderson | 148/400 |
| 5,372,629 | A | 12/1994 | Anderson et al. | 75/332 |
| 6,142,382 | A | 11/2000 | Ting et al. | 239/8 |
| 6,632,394 | B2 * | 10/2003 | Tornberg | B22F 9/082 266/202 |

(Continued)

OTHER PUBLICATIONS

WW I.E. Anderson, R.L. Terpstra, and R.S. Figliola, "Melt Feeding and Nozzle Desing Modification for Enhanced Conntrol of Gas Atomization", Advances in Powder Metallurgy & Particulate Materials, Compiled by C. Ruas, and T.A. Tomlin, Metal Powder Industries Federation, Princeton, NJ, 2004, vol. 2, pp. 26-36.

(Continued)

*Primary Examiner* — George Wyszomierski

(57) ABSTRACT

A concentric ring gas atomization nozzle with isolated gas supply manifolds is provided for manipulating the close-coupled atomization gas structure to improve the yield of atomized powders.

5 Claims, 9 Drawing Sheets

(56) References Cited

U.S. PATENT DOCUMENTS

| | | | | |
|---|---|---|---|---|
| 7,699,905 | B1 | 4/2010 | Anderson | 75/332 |
| 8,197,574 | B1 | 6/2012 | Anderson | 75/332 |
| 2010/0163647 | A1* | 7/2010 | Wurz | B05B 7/0458 239/399 |

OTHER PUBLICATIONS

J.R. Rieken, "Gas atomized precursor alloy powder for oxide dispersion strengthened ferritic stainless steel", PhD Dissertation, in Materials Science and Engineering, Iowa State University, Ames, 2011, p. 335.

G.R. Odette, M.J. Alinger, and B.D. Wirth, "Recent Developments in Irradiation-Resistant Steels", Annu. Rev. Mater. Res., 2008, vol. 38, pp. 471-503.

E.A. Little, "Development of radiation resistant materials for advanced nuclear power plants", Mater. Sci. Technol., 2006, vol. 22, pp. 491-518.

S. Ukai, and M. Fujiwara, "Perspective of ODS alloys application in nuclear environments", I Nucl. Mater., 2002, vol. 307-311, pp. 749-757.

D.T. Hoelzer, J. Bentley, M.A. Sokolov, M.K. Miller, G.R. Odette, and M.J. Alinger, "Influence of particle dispersions on the high-temperature strength of ferritic alloys", J. Nucl. Mater., 2007, vol. 367-370, pp. 166-172.

J.R. Rieken, I.E. Anderson, M.J. Kramer, "Microstructure Evolutipp. 17-31-Atomized Iron-Base ODS Alloys", Int. J. Powder Metall., 2010, vol. 46, pp. 17-21.

I.E. Anderson, R.S. Figliola, and H. Morton, "Flow Mechanisms in high pressure : atomization", Mat. Sci. and Eng., 1991, vol. A148, pp. 101-114.

J.R. Rieken, I.E. Anderson, M.J. Kramer, G.R. Odette, E. Stergar, and E. Haney, "Reactive Gas Atomization Processing for Fe-based ODS Alloys", J. Nucl. Mater., 2012, vol. 428, pp. 65-75.

T.J. Mueller, et al., "Analytical and Experimental Study of Axisymmetic Truncated Plug Nozzle Flow Fileds", 1972, UNDAS TN-601-FR-10., Notre Dame, South Bend.

J.R. Rieken, A.J. Heidloff, and I.E. Anderson, "Oxidation Predictions for Gas Atomization Reaction Synthesis (GARS) Processing", Advances in Powder Metallurgy & Particulate Materials, compiled by I. Donaldson, and N.T. Mares, Metal Powder Industries Federation, Princeton, NJ, 2012, vol. 2, pp. 35-60.

P.I. Espina, and S.D. Ridder, "Aerodynamic Analysis of the Aspiration Phenomena", in Synthesis and Analysis in Materials Processing: Advances in Characterization and Diagnostics of Ceramics and Metal Particulate Processing, E.J. Lavemia, H. Henein, and I.E. Anderson, The Minerals, Metals, and Materials Society, Warrendale, PA, 1989, vol. 1, pp. 49-61.

J. Ting, and I.E. Anderson, "A computation fluid dynamics (CFD) investigation of the wake closure phenomenon", Mater. Sci. Eng., 2004, vol. A379, pp. 264-276.

J. Ting, M.W. Peretti, and W.B. Eisen, "The effect of wake-closure phenomenon on gas atomization performance", Mat. Sci. and Eng., 2002, vol. A326, pp. 110-121.

A. Unal, "Production of rapidly solidified aluminium alloy powders by gas atomisation and their applications", Powder Metallurgy, 1990, vol. 33, pp. 53-64.

A.M. Mullis, et al., "Close-coupled gas atomization: high-frame rate analysis of spray-cone geometry", IJPM 2008, vol. 44, pp. 55-64.

I.E. Anderson, R.L. Terpstra, and R. Figliola, "Measurements of gas recirculation flow in the melt feeding zone of a close-coupled gas atomizatin nozzle", Adanced in Powder Metallurgy & Particulate Materials, Compiled by R. Lawcock, and M. Wright, Metal Powder Industries Federation, Princeton, NJ, 2003, vol. 2, pp. 124-138.

D. J. Byrd, J.R. Rieken, A.J. Heidloff, M.F. Besser, and I.E. Anderson, "Custom Plasma Sprayed Melt Handling Components for Use with Reactive Melt Additions", Advances in Powder Metallurgy & Particulate Materials, Compiled by I. Donaldson, and N.T. Mares, Metal Powder Industries Federation, Princeton, NJ, 2012, vol. 2, pp. 136-151.

A.J. Heidloff, et al., "Advanced Gas Atomization Processing for Ti and Ti Alloy Powder Manufacturing", JOM, 2010, vol. 62, pp. 35-41.

A.H. Shapiro, The Dynamics and Thermodynamics of Compressible Fluid Flow, 1953, John Wiley & Sons, New York.

R. D. Ingebo, "Capillary and Acceleration Wave Breakup of Liquid Jets in Axial-Flow Airstreams", 1981, NASA TP-1791, NASA—Lewis Research Center, National Aeronautics and Space Administration, Scientific and Technical Information Branch, Cleveland, OH USA.

A. M. Mullis, I.N. McCarthy, R.F. Cochrane, and N.J. Adkins, "Investigation of the Pulsation Phenomenon in Close-Coupled Atomization", Advanced in Powder Metallurgy & Particulate Materials, Compiled by I. Donaldson, and N.T. Mares, Metal Powder Industries Federation, Princeton, NJ, 2012, vol. 2, pp. 1-12.

* cited by examiner

ATOMIZER FOR IMPROVED ULTRA-FINE POWDER PRODUCTION

RELATED APPLICATION

This application claims benefit and priority of U.S. provisional application Ser. No. 61/960,726 filed Sep. 24, 2013, the entire disclosure of which is incorporated herein by reference.

CONTRACTUAL ORIGIN OF THE INVENTION

This invention was made with support under Grant No. DE-AC02-07CH11358 awarded by the Department of Energy. The government has certain rights in the invention.

FIELD OF THE INVENTION

The present invention relates to a high pressure gas atomization nozzle for atomizing metallic or other molten material (melt) to produce fine atomized powders useful for making oxide dispersion strengthened (ODS) ferritic stainless steel alloys and for making powders with nearly ideal size yield for additive manufacturing processes.

BACKGROUND OF THE INVENTION

Oxide dispersion strengthened (ODS) ferritic stainless steel alloys are considered excellent material candidates for future generation power systems, due to optimum thermal, mechanical, and nuclear properties [references 1-4]. Gas atomization reaction synthesis (GARS) has previously been demonstrated as a feasible rapid solidification method for the production of precursor ODS ferritic stainless steel powder [reference 5]. During this process, nascent atomized droplets react with small amounts of $O_2$ within the reactive atomization gas to form an ultra-thin (t<50 nm) surface oxide film (e.g., $Cr_2O_3$), [reference 6].

The rapidly solidified GARS powders contain a distribution of Y-enriched intermetallic compound (IMC) precipitates. Heat treatment of the consolidated powders results in an oxygen exchange reaction between the Cr-enriched prior particle boundary (PPB) oxide and Y-enriched IMC precipitates. For this reason, the IMC solidification pattern was found to be a template for the resulting nano-metric Y-enriched oxide dispersoids [reference 8]. The most ideal spatial distribution of Y-enriched IMC precipitates was found in ultra-fine powders (dia.<10 μm), which provided motivation to improve the yield of such powders. Furthermore, an ideal balance between Y and O, based on the stoichiometry of the resulting oxide dispersoids, is required to fully dissolve the PPB oxide [reference 5]. This ideal balance is typically only possible across a narrow range of gas atomized powders, since the O is in the form of a surface oxide and therefore varies as a function of particle surface area [reference 9], which provides further incentive to narrow the resulting powder standard deviation, in order to maximize powder yield containing an ideal Y to O ratio.

The present invention resulted from applicants' effort to increase the yield of ultra-fine powder (i.e., dia.<10 μm) and reduce the resulting powder standard deviation (i.e., $d_{85}/d_{50}$) using a high pressure gas atomization (HPGA) nozzle modified with the intent of enhancing the intensity of the closed-wake gas structure to promote a more prolonged and effective secondary break-up process by confining the molten metal within the recirculation zone and forcing the exiting liquid droplets to traverse the Mach disk. To this end, the close-coupled atomizing nozzle pursuant to the invention contains two concentric rings of discrete gas jets that are supplied from independent gas manifolds, which features are not present in the original design of the discrete jet HPGA nozzle (DJ-HPGA) introduced by Anderson et al. [reference 10].

The original DJ-HPGA nozzle operates with under-expanded gas jets that freely expand as they exit their individual cylindrical passages by means of expansion and compression waves, (Prandtl-Meyer fans), as explained by Espina and Ridder [reference 11]. These expansion and compression waves are reflected at the constant pressure boundary and axis of symmetry, respectively (see FIG. 2*a*). Above a certain pressure threshold, the reflected waves combine together and form incident oblique shocks. These incident shocks converge, forming a shock node that produces two reflected shocks, with one shock reflected toward the boundary layer and the other toward the axis of symmetry (see FIG. 2*a*) [reference 11]. The latter of these reflected shocks will continue to bend and flatten prior to intersecting the axis of symmetry, resulting in the formation of a Mach disk. The formation of the Mach disk truncates the recirculation zone and isolates the wake region, resulting in deep aspiration at the exit orifice of the melt delivery tube [reference 12]. This phenomenon generally occurs at a specific pressure for a given nozzle geometry, gas type (e.g., Ar or $N_2$), and melt delivery tube geometry (e.g., extension length and angle) [reference 13].

The Mach disk is thought to play a germane role in the production of fine powder, both directly and indirectly, as it creates a barrier supported by highly focused gas that isolates the wake region from a high pressure stagnation front [reference 14]. Liquid fragments or droplets are abruptly decelerated as they pass through the Mach disk and crash into the high pressure stagnation front, which helps to further disintegrate the liquid into a fine mist. Consequently, when the Mach disk is disrupted, high pressure from the stagnation front rushes into the low pressure recirculation zone and impedes the liquid stream descent, which forces the liquid to bloom and spread or film across the transverse landing of the melt delivery tube prior to being sheared by supersonic atomization gas along the periphery of the tube (see FIG. 2*b*) [references 15, 16] This pre-filming action has been suggested as a plausible reason for improved fine powder production under closed-wake conditions [reference 15]. This notion agrees well with the fundamental concept of the acceleration wave model [reference 17], inferring that prefilming helps to maximize the mismatch velocity between the liquid and atomization gas and also reduces the melt layer thickness, both of which promote a reduction in resulting average droplet diameter. Moreover, this temporary disruption in liquid flow allows the Mach disk to reestablish, creating deep aspiration that again pulls liquid (e.g., fragments and droplets) into the Mach disk, thus restarting the cycle and giving rise to the term pulsatile atomization. Mullis et al. [reference 18] have empirically studied this pulsation effect using an image analysis routine to evaluate high-speed video stills, in order to calculate the frequency of the pulses and relate them to atomization efficiency in terms of the atomizer being in an open or closed-wake condition. However, a challenge still exists in understanding and controlling this pulsation effect (e.g., changes in frequency and effectiveness of the melt interruption), and how it relates to the resulting particle size distribution.

SUMMARY OF THE INVENTION

The present invention provides a gas atomizing nozzle for atomizing a molten material (melt) wherein concentric ring arrays of discrete gas jet orifices are provided to permit control of the atomizing gas structure to improve production of fine atomized powders with a narrower distribution of powder particle sizes.

An illustrative embodiment of the invention provides a gas atomizing nozzle comprising a first annular array of a plurality of first discrete gas jet orifices arranged about a melt, a first gas supply manifold for supplying pressurized atomizing gas to the first discrete gas jet orifices, a second annular array of a plurality of second discrete gas jet orifices arranged outwardly of the first annular array, and a second gas supply manifold isolated from the first gas supply manifold for supplying pressurized atomizing gas to the second annular array. Different atomizing gas pressures and/or atomizing gas compositions can be provided by the first and second gas supply manifolds to control the atomizing gas structure, such as atomizing gas velocity and pressure profiles, downstream of the atomizing nozzle. The present invention is useful, although not limited to, production of more uniform size, fine atomized precursor ODS stainless steel powder and to the production of powders with nearly ideal size yield, such as about 20 to about 75 μm in diameter, for use in additive manufacturing (AM) processes.

These and other advantages of the present invention will become apparent from the following detailed description taken with the following drawings.

BRIEF DESCRIPTION OF THE DRAWINGS

FIG. 5*a*-5*e* is a series of schlieren images observed when the interior manifold pressure was set and held constant at 6.4 MPa and the exterior manifold was set at: FIG. 5*a*) 0 MPa, FIG. 5*b*) 0.69 MPa, FIG. 5*c*) 0.97 MPa, and FIG. 5*d*) 1.52 MPa, with a horizontal dashed white line indicating the vertical displacement of the Mach disk beyond the original location (FIG. 5*a*) without the influence of gas from the exterior jets, also shown are white arrows highlighting the location of the incident and reflective shock node.

DETAILED DESCRIPTION OF THE INVENTION

A gas atomizing nozzle is provided for atomizing a molten material (melt), which can be a molten metal, molten metal or alloy, molten intermetallic alloy, or other molten material. Features of the gas atomizing nozzle permit control and manipulation of the atomizing gas structure downstream of the atomizing nozzle to improve production of fine atomized powders with a narrower distribution of powder particle sizes (i.e. decreased particle standard deviation). The present invention is especially useful, although not limited to, production of fine atomized precursor ODS stainless steel powder. The present invention is especially useful, although not limited to, production of fine powders with nearly ideal size yield, such as about 20 to about 75 μm in diameter, for additive manufacturing (AM) processes. The gas atomizing nozzle is useful as the melt atomizing nozzle part of an atomizing system of the type described in U.S. Pat. Nos. 5,125,574; 5,228,620, and 5,368,657, the disclosures of all of which are incorporated herein by reference.

Referring to FIGS. 3*b*, 3*c*, 11*a*, and 11*b*, an illustrative embodiment of the invention provides a close-coupled gas atomizing nozzle N comprising a first annular array Al of a plurality of first discrete gas jet orifices 20 arranged about a melt discharged from discharge orifice 10*a* of a melt supply member 10, a first gas supply manifold M1 for supplying pressurized gas to the first discrete gas jet orifices, a second annular array A2 of a plurality of second discrete 20' gas jet orifices arranged circumferentially (radially) and concentrically outwardly around (outboard of) the first annular array A1, and a second gas supply manifold M2 isolated from the first gas supply manifold for supplying pressurized gas to the second annular array A2. The second annular array A2 is shown residing in a horizontal plane axially below the horizontal plane containing the first annular array A1, although the invention is not limited to such particular planar arrangement. In one embodiment of the invention, different atomizing gas pressures can be provided in the first and second gas supply manifolds M1, M2 to control the atomizing gas structure, such as, for example, gas velocity and pressure profiles that establish a closed wake atomizing gas structure with a truncated recirculation zone that is beneficial to increase aspiration at the melt discharge orifice of the melt supply member. The manifold M2 and jets 20' can add supplemental atomizing gas from an independent secondary ring of jets 20' to 1) enhance the gas structure by acting as a buffer between the primary gas structure and constant pressure boundary, and 2) increase the pressure at the stagnation front to augment the strength of the recirculation zone in either the open or closed wake condition.

Figure 11A:
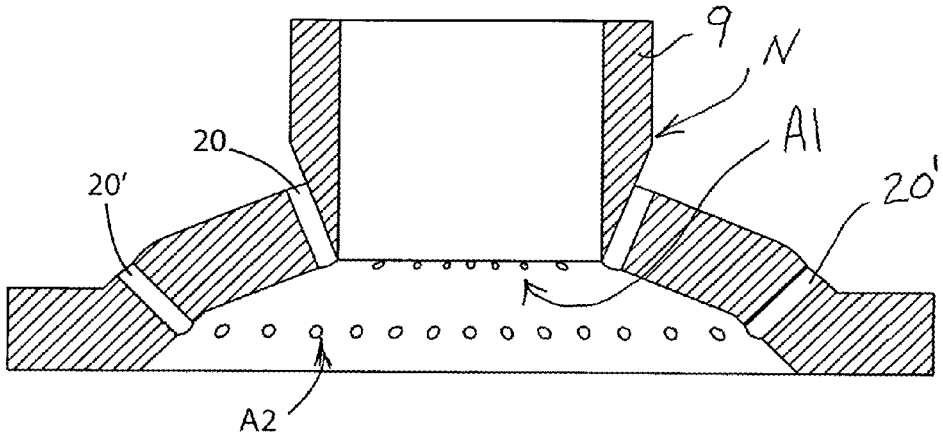
FIG. 11*a* is a central section enlargement of FIG. 3*b* (without the melt supply tube) that clearly shows both the internal (first) gas jets and the external (second) gas jets, but does not show the corresponding independent gas manifolds that communicate with each set of jets (seen in FIG. 3*c*)
Figure 11B:
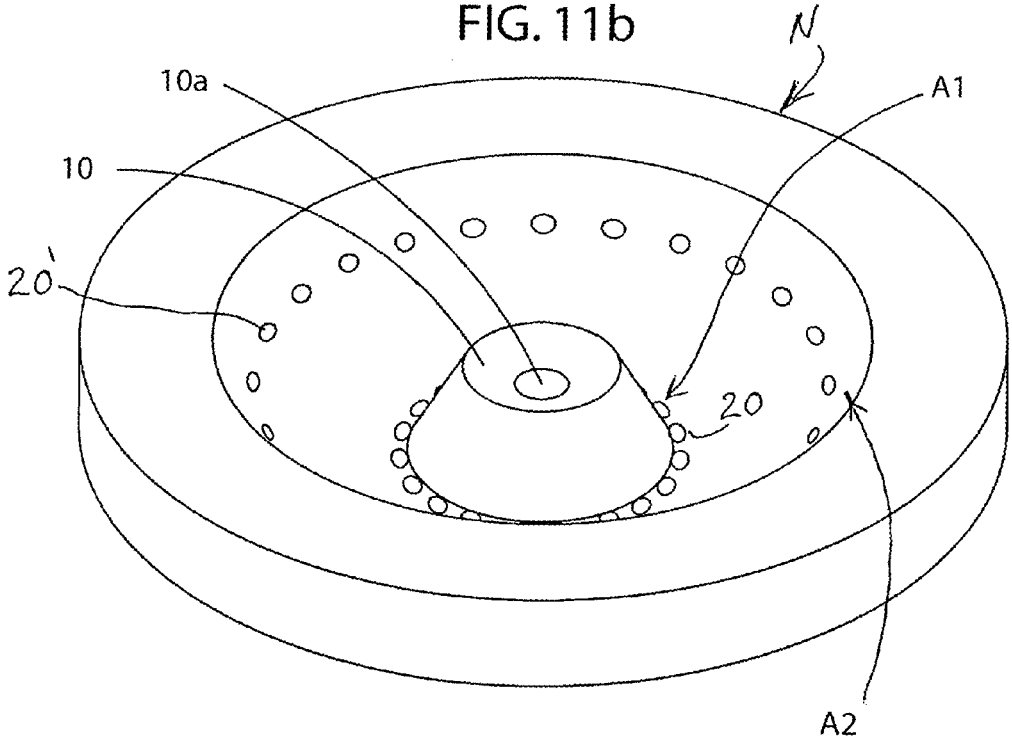
FIG. 11*b* is a perspective view (inverted) of the CR-HPGA nozzle with the melt supply tube from FIG. 3*b*.

For purposes of illustration, the concentric arrays A1, A2 can be machined in a nozzle plate 24, such as for example Type 316 stainless steel plate, or otherwise fabricated. As shown in FIGS. 3*b* and 11*a*, 11*b*, each array A1, A2 comprises a plurality of discrete, circumferentially spaced apart gas jet discharge orifices 20, 20' arranged in an inner circumferential ring and an outer circumferential ring around melt supply discharge orifice 10*a*. For purposes of illustration and not limitation, the apex angle of the orifices 20 of the inner array A1 typically matches the apex angle on the lower discharge end of the melt supply member or tube 10, which has a frusto-conical shaped end defining the apex angle as described in U.S. Pat. Nos. 5,125,574; 5,228,620, and 5,368,657, the disclosures of all of which are incorporated herein by reference. The apex angle of the orifices 20' of the inner array A2 can be the same or different from that of the orifices 20 of the inner array A1. For example, the apex angle of the orifices 20' can be different so that the apex angles form a common gas focal point, although a common gas focal point is not necessary to practice the invention. The melt supply member 10 can be a refractory or ceramic melt delivery tube such as of the type disclosed in U.S. Pat. Nos. 5,125,574 and 5,228,620, the disclosures of which are incorporated herein by reference. The metal supply tube 10 is received in a melt tube-receiving sleeve 9 of the atomizing nozzle N.

Figure 1A:
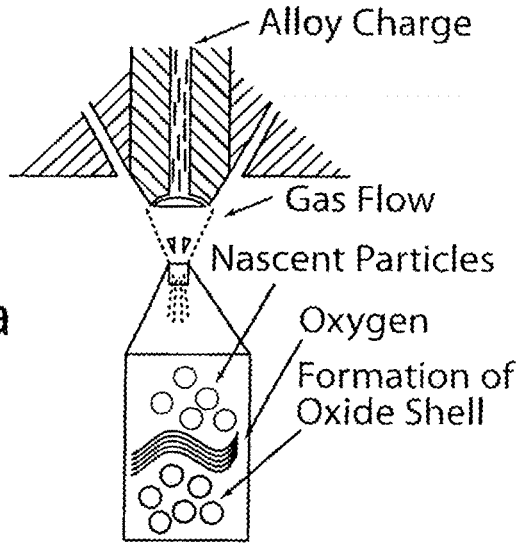
FIG. 1*a*) is a schematic of the gas atomization reaction synthesis (GARS) reaction, FIG. 2*a*) is a schematic showing the under expanded gas flow structure (adapted from [reference 11]), and FIG. 2*b*) shows primary atomization schematic highlighting melt pre-filming (adapted from reference 16]).
Figure 2A:
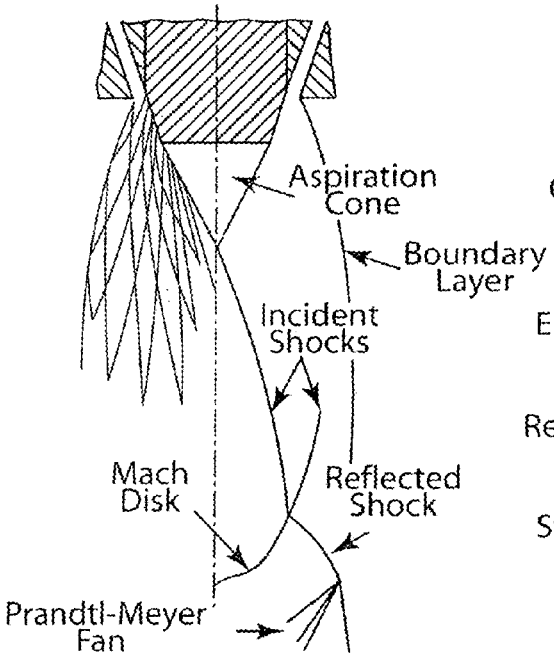
Figure 2B:
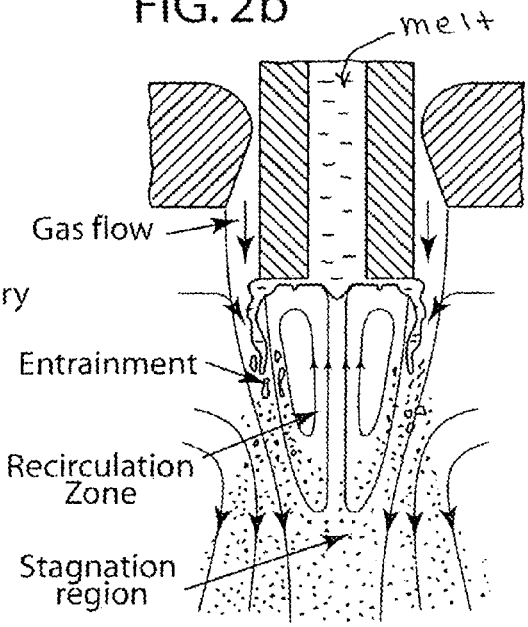
Figure 3A:
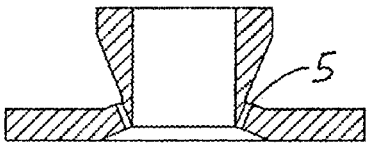
FIG. 3a Prior Art
FIG. 3*a*) is a cross-section schematic of an original DJ-HPGA nozzle type, FIG. 3*b*) is a cross-section schematic of the CR-HPGA nozzle pursuant to an embodiment of the invention, and FIG. 3*c*) is a cross-section schematic of the CR-HPGA nozzle of FIG. 3*b*) taken along another vertical plane highlighting the isolated interior and exterior supply manifolds M1, M2.
Figure 3B:
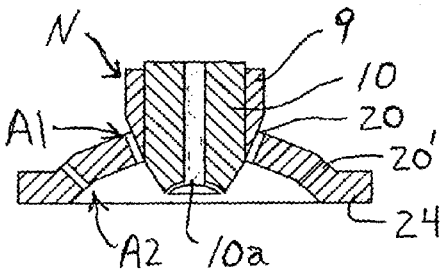
Figure 3C:
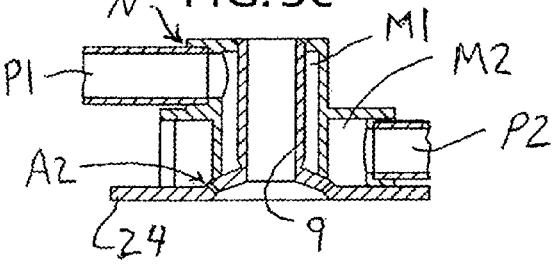

Referring to FIG. 3*c*, the first and second atomizing gas supply manifolds M1, M2 are hermetically isolated from one another so as to independently supply atomizing gas to the respective arrays A1, A2 of discrete, gas jet discharge orifices 20, 20'. The gas supply manifolds M1, M2 are fabricated by welding appropriate walls (e.g. Type 316 stainless steel) to the atomizing nozzle structure as shown in FIG. 3*c*. The atomizing gas supply manifolds M1, M2 are connected to respective atomizing gas supply pipes or conduits P1, P2, which supply separate atomizing gas streams to the respective manifolds M1, M2. For purposes of illustration, the atomizing gas supplied by pipes P1, P2 can be argon mixed with a small amount of oxygen or nitrogen mixed with a small amount of oxygen when atomized precursor ODS (oxide dispersion strengthened) stainless steel powders are to be produced. The atomizing gas supplied by pipes P1, P2 can be argon (or other gas) without any additional reactive or other supplemental gas when fine atomized powders are produced with nearly ideal size yield, such as about 20 to about 75 μm in diameter, for additive manufacturing (AM) processes.

As described below in the example for purposes of illustration and not limitation, the gas supply manifolds M1, M2 can provide atomizing gas at different pressures to the respective arrays A1, A2 in order to control the atomizing gas structure downstream of the atomizing nozzle, such as the atomizing gas velocity and pressure profiles to provide a closed wake atomizing gas structure with a truncated recirculation zone that improves aspiration at the melt discharge orifice 10*a*.

Alternately or in addition, different atomizing gas compositions can be provided in manifolds M1, M2 to this same end or to modify an open wake atomization gas structure.

The following example is offered to illustrate the invention in more detail without limiting the scope of the invention

Example 1

This Example illustrates production of atomized precursor ODS ferritic stainless steel powder using an atomizing nozzle and method pursuant to the present invention.

Procedure:

Nozzle Design:

A schematic comparison between an original DJ-HPGA nozzle type with a single circular array of gas jet orifices 5, FIG. 3*a*, and a concentric ring (CR-HPGA) nozzle is shown in FIGS. 3*b*, 3*c*, 11*a*, and 11*b*. The CR-HPGA nozzle contains an interior array (or ring) of 30 jets (orifices 20) with 0.74 mm dia. and a gas flow apex angle of 45°, with an inter-jet spacing 0.43 mm around an 11.15 mm annulus, similar to the DJ-HPGA nozzle type [reference 10]. Additionally, the CR-HPGA nozzle pursuant to the invention contains a second concentric array or ring of 60 jets (orifices 20') with 0.74 mm dia. and gas flow apex angle of 90°, with an inter-jet spacing of 0.41 mm around a 21.92 mm annulus.

This geometry was selected to create an identical gas flow focal point between the two rings A1, A2 of jets, while the exterior ring A2 of jets (orifices 20') contains twice the cross-sectional area compared to the interior jets (orifices 20). The nozzle plate and both manifolds were fabricated from Type 316 stainless steel plate. The two rings A1, A2 of jets are hermetically isolated (during operation) and supplied from independent gas manifolds M1, M2, allowing significant atomization control (e.g., using independent manifold pressures and/or differing atomization gas compositions).

Nozzle Lab Testing:

Gas only analysis using orifice pressure measurements and schlieren images were used to characterize the aspiration effects and gas structure produced by the CR-HPGA nozzle pursuant to the invention using high-purity Ar gas. For gas only testing, the melt supply tube 10 was substituted for each test by each of a series of matching angle (45°) brass inserts (as a surrogate melt supply tube) which were machined with extensions of 1.52, 2.29, 3.05, and 3.81 mm (i.e., vertical distance below the interior rim or "stick-out") and inserted in the atomizing nozzle in place of the melt supply tube 10. The brass inserts were attached to a pressure transducer to measure the aspiration pressure at the insert tip. A separate pressure transducer was inserted into a "stagnant" region of each active gas manifold to record the supply pressure. The CR-HPGA nozzle was plumbed in a manner to operate the interior and exterior manifolds M1, M2 at equal or independent pressures. Z-type schlieren diffraction images were recorded using a digital camera with an exposure setting of $1/400^{th}$ of a sec. and an aperture setting of f/5D. More details about schlieren imaging can be found in the literature [reference 19].

Atomization Trial:

The nominal atomization charge chemistry is displayed in Table 1. The reactive atomization gas composition was calculated using a previously reported GARS oxidation model based on droplet cooling curves [reference 9]. The charge was melted in a $ZrO_2$ bottom pour crucible and superheated to 1750° C. The melt pour was initiated by raising a pneumatically actuated composite (YSZ—W—$Al_2O_3$) stopper rod, which allowed the molten alloy to flow through a plasma sprayed YSZ (yittria-stabilized zirconia) melt delivery tube (melt supply tube 10) with a 4.75 mm dia. exit orifice and a 2.29 mm matching angle (45°) extension (see FIG. 3*b*) [reference 21 and U.S. Pat. Nos. 5,125,574 and 5,228,620].

TABLE 1

Nominal Fe-based ODS alloy chemistry used for the experimental atomization trial.

| | Fe | Cr | Al | W | Hf | Y | O | Rxn. gas (vol. %) |
|---|---|---|---|---|---|---|---|---|
| Nominal (at. %) | Bal. | 16.0 | 12.3 | 0.90 | 0.25 | 0.25 | — | Ar-0.03$O_2$ |

Prior to the atomization trial, the CR-HPGA nozzle was installed into an experimental (5 kg Fe) close-coupled gas atomizer system and the aforementioned manifold pressure transducers were used to calibrate the atomization supply pressure. Upon exiting the pouring orifice melt discharge orifice 10*a*), the melt was immediately impinged by the reactive atomization gas, which reactive atomization gas contained 0.03 vol. % $O_2$ mixed with high purity Ar and was directly injected through the CR-HPGA nozzle. The interior manifold pressure (manifold M1) was operated at 6.38 MPa and the exterior manifold pressure (manifold M2) was operated at 0.69 MPa.

High-speed video of the atomization trial was captured using a Phantom 7.1 high-speed digital video camera from Vision Research with a Nikon 85 mm f/1.8D AF Nikkor lens, set to f/16. Self-illumination of the molten alloy spray was sufficient to visualize and capture video. A frame rate of 5,000 frames per second (fps) was selected as an optimum balance between video resolution and frame duration. Video capture was initiated once the atomization process had reached steady-state (i.e., both the interior and exterior manifolds had achieved the targeted supply pressure).

The resulting as-atomized powders were mechanically screened using a 106 μm ASTM sieve to eliminate a small amount of atomization fragments (e.g., splats and ribbon), and then spin riffled to generate several statistically random samples for particle size analysis. A statistically representative sample was evaluated using a Microtrac unit (Nikkiso Co., Ltd.). Alternatively, a second statistical sample was loaded onto carbon tape for SEM analysis, in order to confirm particle size and morphology.

Results

Figure 4A:
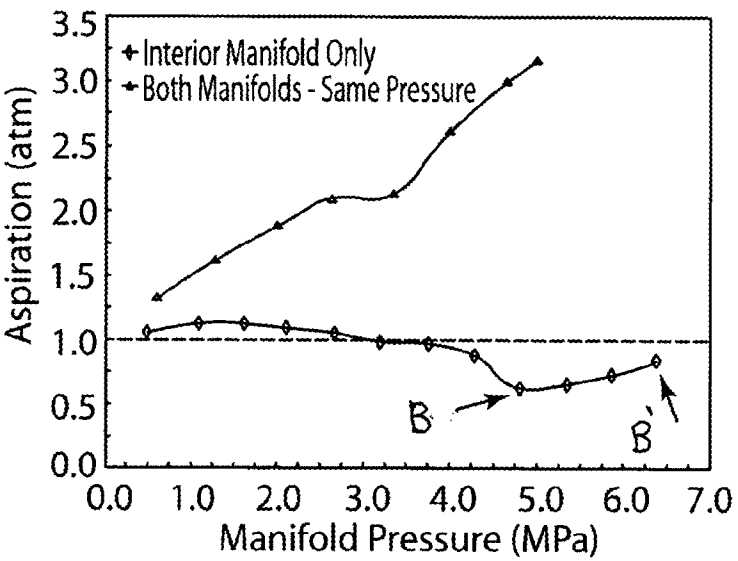
FIG. 4*a*) shows aspiration curves for the CR-HPGA nozzle using Ar gas with a matching insert tip extension of 2.29 mm with only the interior manifold (lower curve) or both interior and exterior manifolds operating at identical pressures (upper curve).

Aspiration Results and Gas Structure:

The aspiration results for the CR-HPGA nozzle with a 2.29 mm matching angle)(45° insert extension are shown in FIG. 4*a*. Initial operating conditions, where both the interior and exterior manifolds maintained identical supply pressures, created a positive orifice pressure that began at 1.3 atm and continued to rise to 3.1 atm as the supply pressure was increased from 0.6 to 5.0 MPa (see upper curve in FIG. 4*a*). This type of non-aspiration effect is considered non-ideal, since it would likely prevent the liquid metal from exiting the melt delivery tube unless excessive melt over-pressure was used.

Alternatively, a more typical closed-wake aspiration curve was generated when only operating the interior set of jets (see lower curve in FIG. 4*a*). As the interior jet pressure was increased, using 0.5 MPa increments, the orifice pressure slightly increased above 1 atm until reaching a manifold (M1) pressure of 3.2 MPa. The wake closure pressure (WCP) was recorded at 4.8 MPa (see arrow B in FIG. 4*a*), as indicated by the sharp drop in aspiration pressure. As previously mentioned, this occurs due to Mach disk formation and therefore isolation of the recirculation zone from the high pressure stagnation front [reference 14]. The orifice pressure then continued to rise as the manifold pressure was increased above WCP, as a result of more gas entering the recirculation zone. The Mach disk is formed by the combination of two reflected shocks and truncates the recirculation zone as described below. The Mach disk also isolates the recirculation zone from the stagnant pressure region. The Mach disk generally occurs (with sharpest focus) at a specific pressure for a given nozzle geometry gas type (e.g. Ar or $N_2$) and melt supply tube geometry (e.g. tube extension length and apex angle).

Figure 4B:
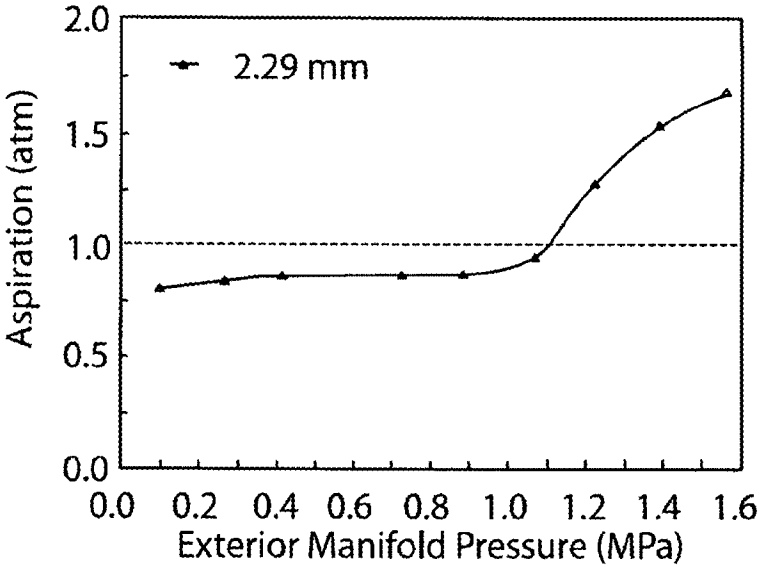
FIG. 4*b*) shows aspiration threshold measurement using a 2.29 matching insert tip extension with a constant interior manifold pressure of 6.4 MPa.

A constant interior manifold pressure of 6.4 MPa (see arrow B' in FIG. 4*a*) was selected for an initial threshold study, in which the supply pressure in the exterior manifold was slowly increased from 0.1 to 1.56 MPa. During this study, nearly constant aspiration was maintained at a level consistent with operating only the interior set of jets (see lower curve in FIG. 4*a*), until the exterior manifold pressure was increased above 0.95 MPa. Above this threshold pressure, the orifice pressure sharply increased above 1 atm (see FIG. 4*b*), indicating possible break-down of the Mach disk.

In an effort to further understand the aspiration results, schlieren diffraction imaging was used to evaluate changes in the gas structure. A series of schlieren images that were captured using a matching 2.29 mm insert extension with a constant interior manifold pressure of 6.4 MPa and varying exterior manifold pressures from 0 to 1.52 MPa are displayed in FIG. 5*a*-5*e*. This set of images highlights changes in the vertical displacement of the Mach disk as the exterior manifold pressure is increased (see horizontal dashed white line in FIG. 5*a*-5*e*). Furthermore, the recirculation zone gas pattern (i.e., the shock bottle) appeared much sharper when gas was flowing from the exterior manifold, as highlighted in FIG. 5*a* (exterior manifold at 0 MPa) compared to FIG. 5*b* (exterior manifold at 0.69 MPa). Moreover, the shock node (i.e., intersection between the incident and reflective shocks) was found to be at a constant vertical displacement, and uninfluenced by the exterior manifold pressure (see white arrows in FIG. 5*a*-5*e*).

The expansion waves from the exterior jets seemed to help organize the primary gas structure by creating a fluid barrier, which is thought to facilitate a reduction in drag caused by turbulent mixing between the primary (interior) gas structure and the constant pressure boundary. As the exterior manifold pressure is increased, the recirculation zone becomes truncated and a broader Mach disk appears (see FIG. 5*a*-5*e*). It is believed that the stagnation pressure increases with increasing exterior manifold pressure, creating a larger force that pushes against the Mach disk and causes the recirculation zone to deform. As the recirculation zone becomes more and more truncated, the Mach disk is pushed upwards and approaches its origin (i.e., the shock node). When the Mach disk intersects this shock node, it can no longer be displaced as a whole, and begins to bow, eventually breaking down and allowing the high pressure within the stagnation front to flow into the recirculation zone, resulting in a sharp rise in local orifice pressure (see FIG. 5*e* and FIG. 4*b*). This provides consideration for what might occur when liquid metal disrupts the Mach disk (i.e., allowing the stagnation pressure to rush into the recirculation zone), suggesting that the CR-HPGA nozzle parameters could be used to engineer varying pressures within the stagnation front, in an effort to adjust the dynamics (e.g., frequency) of the pulsation effect witnessed during closed-wake atomization that uses the typical single set of gas jets or gas slit.

Figure 6A:
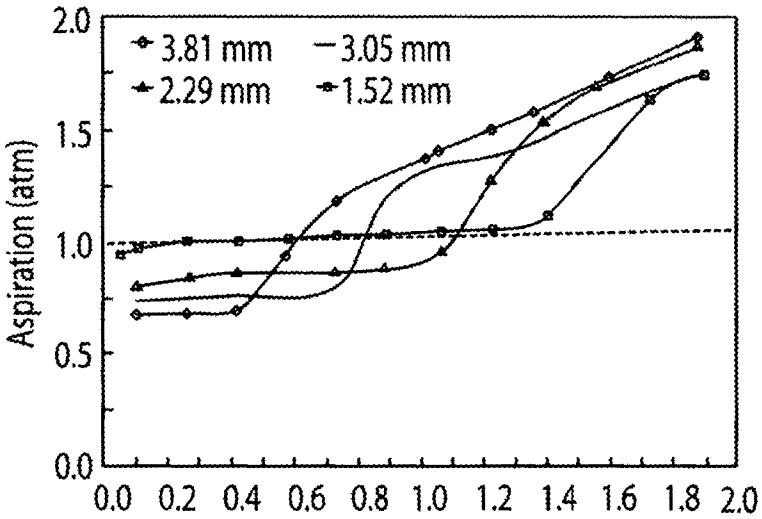
FIG. 6*a*) shows aspiration threshold curves using a constant interior manifold pressure of 6.4 MPa while varying the matching insert tip extension.

Further testing revealed that the threshold pressure was indirectly related to insert extension length (of the surrogate melt supply tube) as shown in FIG. 6*a*. Additionally, it seemed that longer extensions could maintain deeper aspiration for a given interior manifold pressure above WCP (e.g., 6.4 MPa), but also had a much lower threshold pressure. For example, when doubling the insert extension from 1.52 to 3.05 mm the threshold pressure was halved from 1.4 to 0.7 MPa, indicating a possible inverse linear relationship between insert extension and threshold pressure.

Figure 7A:
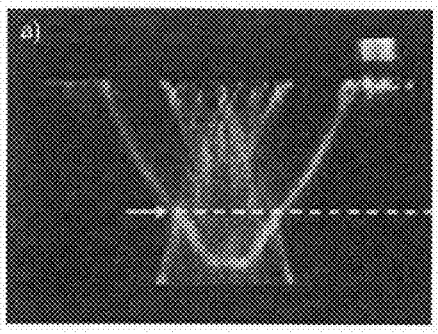
FIG. 7*a*-7*b* is a set of schlieren images highlighting the gas structure of the CR-HPGA nozzle with an interior manifold pressure of 6.4 MPa and exterior pressure of 0.34 MPa with a matching insert tip extension of FIG. 7*a*) 2.29 mm and FIG. 7*b*) 3.05 mm, with white arrows indicating the vertical displacement of the incident and reflective shock nodes.
Figure 7B:
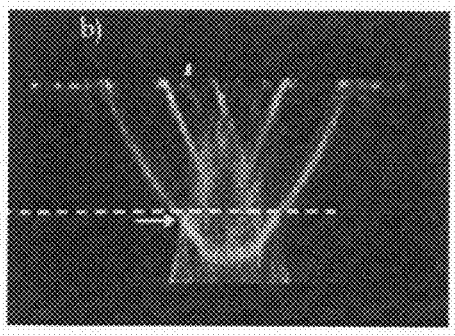

Schlieren images also were used to evaluate the differences in gas structure when using identical CR-HPGA nozzle parameters (i.e., interior manifold pressure of 6.4 MPa and exterior manifold pressure of 0.34 MPa) while modifying the length of the matching insert tip extension from 2.29 to 3.05 mm (see FIG. 7*a*-7*b*). Interestingly, the vertical displacement of the shock node was found to be shifted further downstream with increasing insert tip extension (see white arrows in FIG. 7*a*-7*b*), while the location of the Mach disk remained constant. Therefore, as the recirculation zone became more truncated, the Mach disk associated with longer extension lengths intersected the shock node at lower exterior manifold pressures, resulting in break-down of the Mach disk at a lower threshold pressure, as indicated in FIG. 6*a*.

Figure 6B:
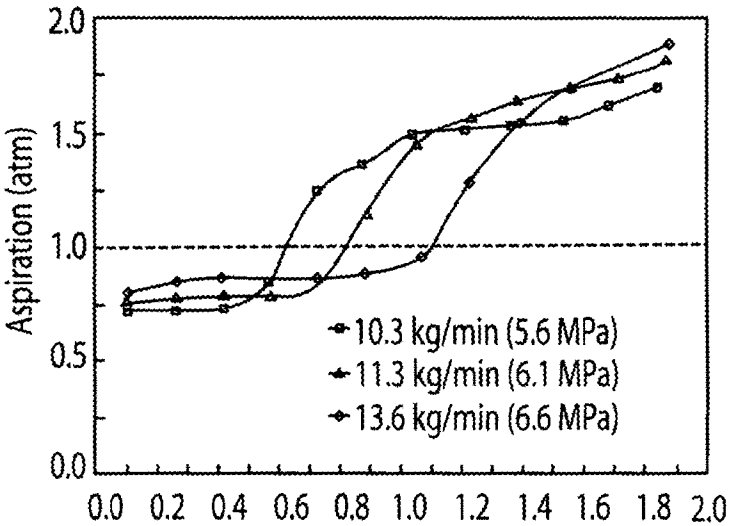
FIG. 6*b*) shows aspiration threshold curves using a constant matching insert tip extension of 2.29 mm while varying the interior (first) jet gas mass flow rate.

Moreover, it also was found that the threshold pressure could be extended using an increased gas mass flow rate through the interior set of jets for a given matching insert extension (i.e., 2.29 mm), as shown in FIG. 6*b*). A gas mass flow rate of 10.3, 11.3, and 13.6 kg/min was found to have a threshold pressure of 0.4, 0.7, and 1.1 MPa, respectively.

It appears that at lower interior jet mass flow rates, the recirculation zone is more easily manipulated (i.e., truncated) as the exterior manifold pressure is increased. Suggesting a force balance exists between the pressure within the recirculation zone and stagnation front. Therefore, as the strength or pressure within the recirculation zone is increased (indicated by the rise in orifice pressure above WCP in FIG. 4*a*), the threshold pressure to disrupt the Mach disk (i.e., push the Mach disk above the shock node) also must be increased, as shown in FIG. 6*b*.

Figures 5A, 5B, 5C, 5D, 5E:
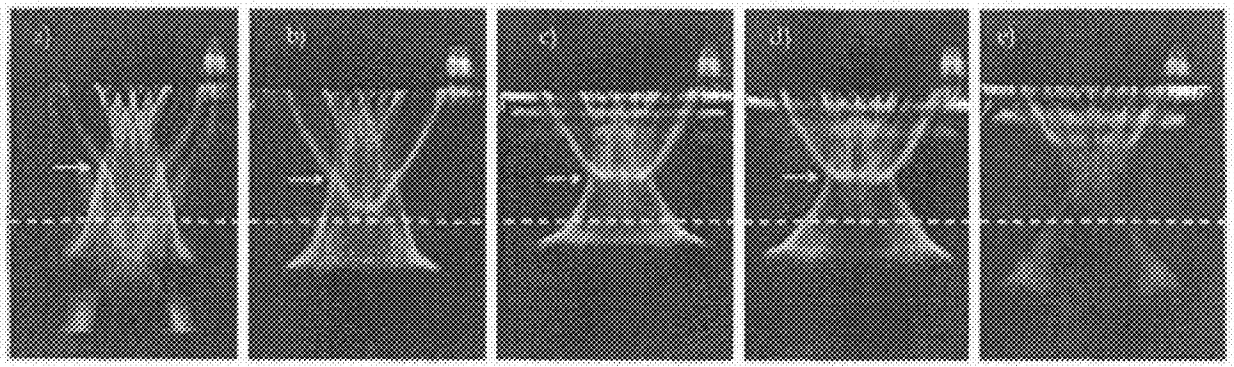

Initial Gas Atomization Trial:

Following gas structure assessment of the CR-HPGA nozzle pursuant to the invention, atomization run parameters were selected to maintain aspiration in the closed-wake condition, with an enhanced recirculation zone, while operating with an apparent increased stagnation pressure front. An example of the selected gas structure is shown in FIG. 5*b* (i.e., produced from an interior manifold pressure of 6.4 MPa and exterior manifold pressure of 0.69 MPa).

The resulting combined gas mass flow rate was measured at 15.7 kg/min (i.e., interior jets: 13.1 kg/min and exterior jets: 2.6 kg/min) and the metal mass flow rate was measured at 1.15 kg/min, resulting in a gas-to-metal ratio (GMR) of 13.6. The resulting metal mass flow rate was found to be significantly lower than a predicted value of 11.1 kg/min (using a modified Bernoulli's equation that combines metallostatic head and aspiration pressure), providing strong initial evidence of interrupted flow or pulsatile atomization.

Figure 8A:
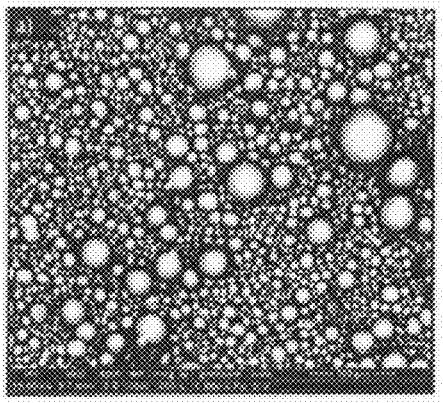
FIG. 8*a*-8*b* are SEM images of statistically representative as-atomized powders FIG. 8*a*) at 250× and FIG. 8*b*) at 1000×.
Figure 8B:
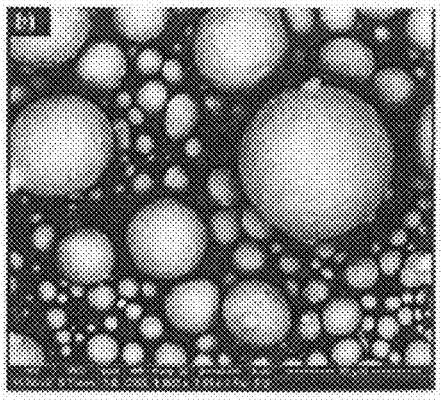

Preliminary particle size distribution analysis of the resulting as-atomized powders determined an average particle diameter ($d_{50}$) of 28.8 μm with a standard deviation ($d_{84}/d_{50}$) of 1.85. The yield of powders within the ultra-fine size range (i.e., dia.<10 μm) was found to be approximately 9.0 vol. %. A statistically representative sample of as-atomized powder is shown in FIG. 8*a*-8*b*. The powders appeared to be quite spherical, with very few surface defects.

Figure 9A:
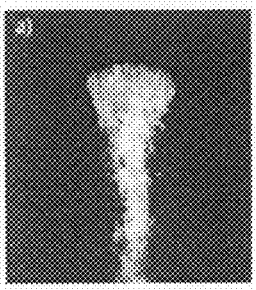
FIG. 9*a*-9*f* is a series of high-speed still images separated by a 40 ms interval is used to illustrate the pulsatile atomization effect that occurred during experimental GARS trial (9*a*-9*f*).
Figure 9B:
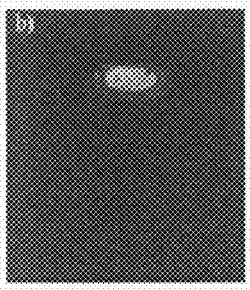
Figure 9C:
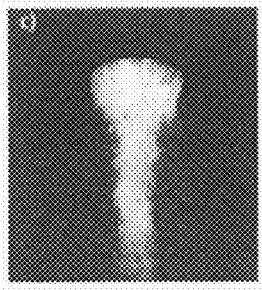
Figure 9D:
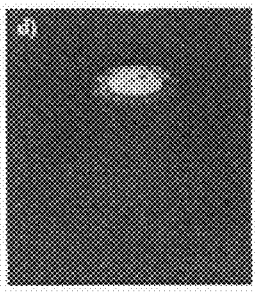
Figure 9E:
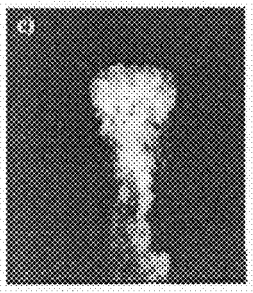
Figure 9F:
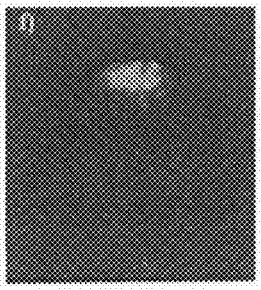
Figure 10A:
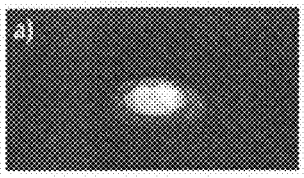
FIG. 10*a*-10*f* is a sequence of high-speed video still images separated by a 0.4 ms interval, showing that as the liquid metal exits the melt delivery tube, it is immediately forced to film across the transverse landing prior to being sheared at the periphery of the tube by the supersonic atomization gas.
Figure 10B:
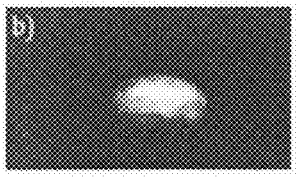
Figure 10C:
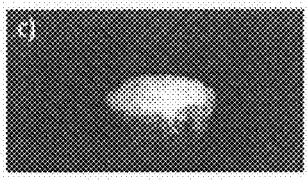
Figure 10D:
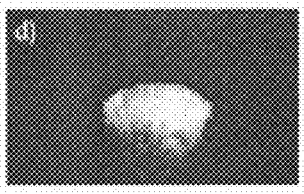
Figure 10E:
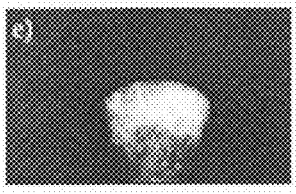
Figure 10F:
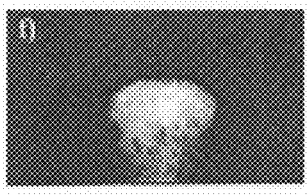

High-speed video confirmed the presence of a pulsation effect during this atomization trial. A sequence of video stills, spaced at a constant time interval, is displayed in FIG. 9*a*-9*f*. It can be seen that the atomization stream clearly pulses between on and off about every 40 ms (comparing FIG. 9*a* and FIG. 9*b*). The pulses seemed to be quite regular with an apparent frequency of about 11 Hz, which was determined by comparing images and measuring the real time between stream re-initiation. The atomization stream also seemed quite confined, with very little metal escaping the recirculation zone (i.e., being drawn into the Mach disk), which helped to promote a systematic and regular pulsation effect. When the Mach disk was disrupted, the high pressure at the stagnation front rushed into the recirculation zone with such intensity that it completely, albeit momentarily, choked off the liquid flow by forcing the metal to reverse its direction. This type of definitive pulsation agrees well with the aspiration results (FIG. 4*b*) coupled with schlieren imaging (FIG. 5*a*-5*e*) that clearly showed a sharp rise in local orifice pressure when the Mach disk was disrupted.

This type of prolonged pulsation seemed to result in a lower frequency (about 11 Hz) compared to other previously reported frequencies (about 30 Hz) produced using a more traditional close-coupled nozzle [reference 22], but further image analysis will be required to more accurately quantify these differences. Moreover, this type of enhanced pulsation, might be considered excessive, since liquid flow was cycled completely on and off with finite amounts of molten metal being momentarily trapped within the melt delivery tube, causing the liquid to lose superheat while also absorbing $O_2$ from the reactive atomization gas, creating a more viscous alloy liquid prior to atomization. For this reason, future atomization trials may use a heated pour tube (shown in [references 21, 23]) that can help maintain or increase superheat in the liquid alloy as it resonates in the melt delivery tube, while also using a non-reactive atomization gas (e.g., UHP Ar), in order to more carefully evaluate this pulsation effect on particle size distribution.

An additional continuous sequence of high-speed video stills was selected to show the strength of the recirculation zone. As the metal melt exits the delivery tube it is immediately forced to film across the transverse landing of the tube prior to being sheared by the supersonic atomization gas at the periphery of the tube (see FIG. 10*a*-10*f*). This provides evidence that the CR-HPGA nozzle of the invention creates a stronger recirculation zone, as a direct effect of being truncated (i.e., decreased in volume, see FIG. 5*a*-5*e*), until the pressure within this region equilibrates with the elevated pressure at the stagnation front. Furthermore, the liquid also appears to wet evenly across the periphery of the tube, without precessing or overwhelming a few select number of jets, suggesting that gas within the recirculation zone is traveling upward along the axis of symmetry and being distributed evenly across the orifice of the tube, which has been shown as a plausible method to help narrow droplet standard deviation [reference 24].

Example 2

This Example illustrates production of fine atomized powder with a nearly ideal size yield using an atomizing nozzle and method pursuant to the present invention for use of the powders in additive manufacturing processes including 3D printing.

Procedure:

Nozzle Design:

The CR-HPGA nozzle of the type described above for the Atomization Trial of Example 1 was used to produce an enhanced closed wake structure (truncated recirculation zone) but using ultra high purity (UHP) argon gas supplied to both of the manifolds M1, M2. The YSZ melt delivery tube had a melt discharge orifice diameter of 3.8 mm instead of the 4.75 mm in diameter of in Example 1.

Atomization Trial:

Prior to the atomization trial, the CR-HPGA nozzle was installed into an experimental (5 kg Fe) close-coupled gas atomizer system and the aforementioned manifold pressure transducers were used to calibrate the atomization supply pressure. Upon exiting the pouring orifice melt discharge orifice 10*a*, the iron-based melt (1 atomic % Cr-balance Fe) at a pour temperature of 1750 degrees C. was immediately impinged by the inert (Ar) atomization gas, which inert atomization gas was directly injected through the CR-HPGA nozzle. To produce desired the closed wake structure, the interior manifold pressure (manifold M1) was operated at 925 psi Ar, and the exterior manifold pressure (manifold M2) was operated at 100 psi Ar. Combined gas mass flow rate was 15.8 kg/min and (fully expanded) gas velocity was 720 m/s. A downstream passivation halo was used (at 1250 mm downstream of the atomization nozzle) and discharged. argon gas with 800 ppm volume % oxygen at 150 psi to lightly passivate the powder particles with a chromium oxide film as they fell through the drop tube (spray chamber) of the atomizer system. Such a passivation halo is described in U.S. Pat. Nos. 5,368,657, 7,699,905; and 8,197,574, the disclosures of which are incorporated herein by reference. This Example produced an increased yield of 20-75 μm diameter powders with less ultra-fine powder (diameter less than 20 μm) being produced. For example, 92% of powder had a diameter of less than 75 μm, 18.1% of powder had a diameter less than 20 μm, and yield of powder with diameter of 20-75 μm was 74%.

Figure 12A:
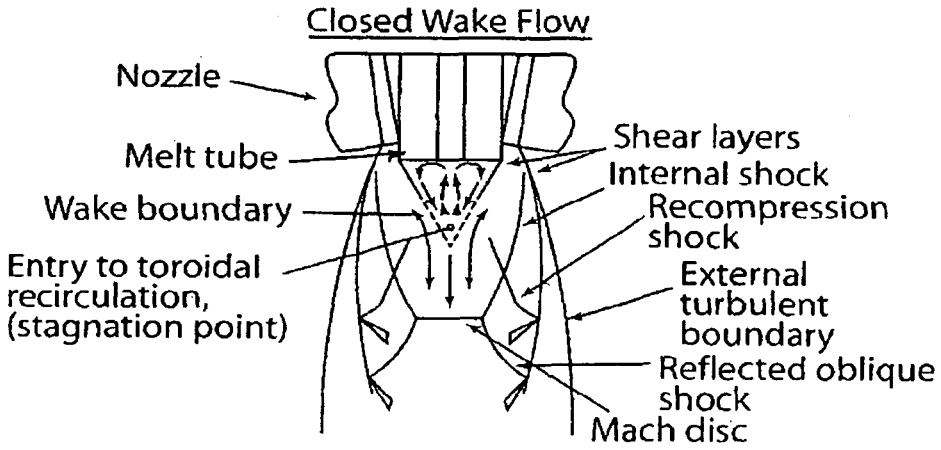
FIG. 12*a* and FIG. 12*b* illustrates a central cross-section of a closed wake gas structure and an open wake gas structure, respectively, obtainable by independent control of the gas supply pressures of each manifold of the atomizing nozzle of the invention (shown as emanating from only the internal (first) gas jets for this illustration).
Figure 12B:
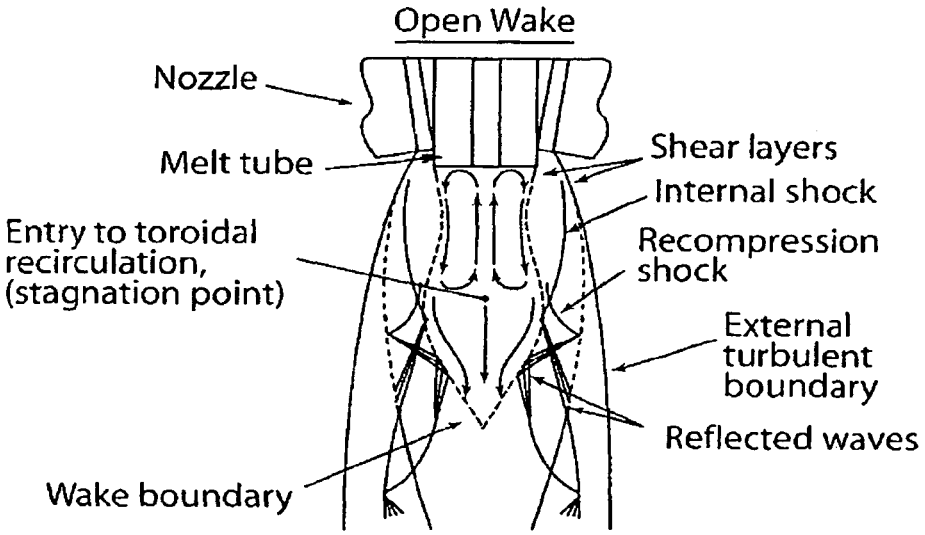

FIG. 12*a* and FIG. 12*b* illustrate a central cross-section of a closed wake gas structure and an open wake gas structure, respectively, obtainable by independent control of the gas supply pressures of each manifold of the atomizing nozzle of the invention (shown as emanating from only the internal (first) gas jets for this illustration). The invention envisions using the open wake gas structure for maintaining a higher metal flow rate during atomization by de-emphasizing the intensity of the pulsing mechanism. Also, the invention envisions independently controlling gas pressures in respective manifolds M1, M2 to shift the gas structure from a closed wake gas structure to a high intensity open wake gas structure Although the invention has been described with respect to certain embodiments, those skilled in the art will appreciate that modifications and changes can be made thereto within the scope of the invention as set forth in the appended claims.

REFERENCES, WHICH ARE INCORPORATED HEREIN BY REFERENCE

[1] G. R. Odette, M. J. Alinger, and B. D. Wirth, "Recent Developments in Irradiation-Resistant Steels", Annu. Rev. Mater. Res., 2008, vol. 38, pp. 471-503.

[2] E. A. Little, "Development of radiation resistant materials for advanced nuclear power plants", Mater. Sci. Technol., 2006, vol. 22, pp. 491-518.

[3] S. Ukai, and M. Fujiwara, "Perspective of ODS alloys application in nuclear environments", I Nucl. Mater., 2002, vol. 307-311, pp. 749-757.

[4] D. T. Hoelzer, J. Bentley, M. A. Sokolov, M. K. Miller, G. R. Odette, and M. J. Alinger, "Influence of particle dispersions on the high-temperature strength of ferritic alloys", J. Nucl. Mater., 2007, vol. 367-370, pp. 166-172.

[5] J. R. Rieken, I. E. Anderson, M. J. Kramer, "Microstructure Evolution of Gas-Atomized Iron-Base ODS Alloys", Int. J. Powder Metall., 2010, vol. 46, pp. 17-21.

[6] I. E. Anderson, and R. L. Terpstra, "Dispersoid Reinforced Alloy Powder and Method of Making", U.S. Pat. No. 7,699,905, 2010.

[7] J. R. Rieken, "Gas atomized precursor alloy powder for oxide dispersion strengthened ferritic stainless steel", PhD Dissertation, in Materials Science and Engineering, Iowa State University, Ames, 2011, p. 335.

[8] J. R. Rieken, I. E. Anderson, M. J. Kramer, G. R. Odette, E. Stergar, and E. Haney, "Reactive Gas Atomization Processing for Fe-based ODS Alloys", J. Nucl. Mater., 2012, vol. 428, pp. 65-75.

[9] J. R. Rieken, A. J. Heidloff, and I. E. Anderson, "Oxidation Predictions for Gas Atomization Reaction Synthesis (GARS) Processing", Advances in Powder Metallurgy & Particulate Materials, compiled by I. Donaldson, and N. T. Mares, Metal Powder Industries Federation, Princeton, N.J., 2012, vol. 2, pp. 35-60.

[10] I. E. Anderson, R. S. Figliola, and H. Morton, "Flow Mechanisms in high pressure atomization", Mat. Sci. and Eng., 1991, vol. A148, pp. 101-114.

[11] P. I. Espina, and S. D. Ridder, "Aerodynamic Analysis of the Aspiration Phenomena", in Synthesis and Analysis in Materials Processing: Advances in Characterization and Diagnostics of Ceramics and Metal Particulate Processing, E. J. Lavernia, H. Henein, and I. E. Anderson, The Minerals, Metals, and Materials Society, Warrendale, Pa., 1989, vol. 1, pp. 49-61.

[12] T. J. Mueller, et al., "Analytical and Experimental Study of Axisymmetic Truncated Plug Nozzle Flow Fileds", 1972, UNDAS TN-601-FR-10., Notre Dame, South Bend.

[13] I. E. Anderson, R. L. Terpstra, and R. Figliola, "Measurements of gas recirculation flow in the melt feeding zone of a close-coupled gas atomizatin nozzle", Adanced in Powder Metallurgy & Particulate Materials, Compiled by R. Lawcock, and M. Wright, Metal Powder Industries Federation, Princeton, N.J., 2003, vol. 2, pp. 124-138.

[14] J. Ting, and I. E. Anderson, "A computation fluid dynamics (CFD) investigation of the wake closure phenomenon", Mater. Sci. Eng., 2004, vol. A379, pp. 264-276.

[15] J. Ting, M. W. Peretti, and W. B. Eisen, "The effect of wake-closure phenomenon on gas atomization performance", Mat. Sci. and Eng., 2002, vol. A326, pp. 110-121.

[16] A. Unal, "Production of rapidly solidified aluminium alloy powders by gas atomisation and their applications", Powder Metallurgy, 1990, vol. 33, pp. 53-64.

[17] R. D. Ingebo, "Capillary and Acceleration Wave Breakup of Liquid Jets in Axial-Flow Airstreams", 1981, NASA TP-1791, NASA-Lewis Research Center, National Aeronautics and Space Administration, Scientific and Technical Information Branch, Cleveland, Ohio USA.

[18] A. M. Mullis, et al., "Close-coupled gas atomization: high-frame rate analysis of spray-cone geometry", IJPM 2008, vol. 44, pp. 55-64.

[19] A. H. Shapiro, The Dynamics and Thermodynamics of Compressible Fluid Flow, 1953, John Wiley & Sons, New York.

[20] Materials Preparation Center, Ames Laboratory, US DOE Basic Energy Sciences, Ames, Iowa, USA, available from: www.mpc.ameslab.gov.

[21] D. J. Byrd, J. R. Rieken, A. J. Heidloff, M. F. Besser, and I. E. Anderson, "Custom Plasma Sprayed Melt Handling Components for Use with Reactive Melt Additions", Advances in Powder Metallurgy & Particulate Materials, Compiled by I. Donaldson, and N. T. Mares, Metal Powder Industries Federation, Princeton, N.J., 2012, vol. 2, pp. 136-151.

[22] A. M. Mullis, I. N. McCarthy, R. F. Cochrane, and N. J. Adkins, "Investigation of the Pulsation Phenomenon in Close-Coupled Atomization", Advanced in Powder Metallurgy & Particulate Materials, Compiled by I. Donaldson, and N. T. Mares, Metal Powder Industries Federation, Princeton, N.J., 2012, vol. 2, pp. 1-12.

[23] A. J. Heidloff, et al., "Advanced Gas Atomization Processing for Ti and Ti Alloy Powder Manufacturing", JOM, 2010, vol. 62, pp. 35-41.

[24] I. E. Anderson, R. L. Terpstra, and R. S. Figliola, "Melt Feeding and Nozzle Desing Modification for Enhanced Conntrol of Gas Atomization", Advances in Powder Metallurgy & Particulate Materials, Compiled by C. Ruas, and T. A. Tomlin, Metal Powder Industries Federation, Princeton, N.J., 2004, vol. 2, pp. 26-36.

We claim:

1. A discrete gas jet nozzle for atomizing a melt, comprising a melt supply tube having a melt discharge orifice, a first annular array of a plurality of first discrete gas orifices arranged about the periphery of the melt supply tube to discharge gas jets toward the melt discharge orifice, a first gas supply manifold for supplying pressurized gas to the first discrete gas jet orifices, a second annular array of a plurality of second discrete gas jet orifices arranged outwardly of the first annular array, and a second gas supply manifold isolated from the first gas supply manifold for supplying pressurized gas to the second annular array, wherein the first gas supply manifold and the second gas supply manifold supply atomizing gas to the first annular array and the second annular array in a manner to control an atomizing gas flow structure to have a gas recirculation zone immediately below the melt discharge orifice.

2. The nozzle of claim 1 wherein the first gas supply manifold and the second gas supply manifold have such different gas supply pressures as to form a more truncated gas recirculation zone as compared to a gas recirculation zone formed without pressurized gas in the second gas supply manifold.

3. The nozzle of claim 1 wherein the first gas supply manifold and second gas supply manifold have different atomizing gas compositions.

4. The atomizing nozzle of claim 1 wherein the first gas supply manifold and second gas supply manifold have the same atomizing gas.

5. The atomizing nozzle of claim 1 wherein the second annular array of a plurality of second discrete gas jet orifices is arranged outwardly of and downstream of the first annular array.

* * * * *